US007855660B2

(12) United States Patent
Kim et al.

(10) Patent No.: US 7,855,660 B2
(45) Date of Patent: Dec. 21, 2010

(54) MULTIPURPOSE LED SIGNAL SYSTEM FOR PEDESTRIAN AND TRAFFIC CONTROL

(76) Inventors: Jong Hae Kim, Shinhan Technology Institute, 704, Union Center, Suite, 837-11 Yoksam-dong, Kangnam-ku, Seoul (KR) 135-080; Tommy Y. Kim, 1501 W. Toscanini Dr. Rancho, Palos Verdes, CA (US) 90275; Kyoung Ja Han, Shinhan Technology Institute, 704, Union Center, Suite, 837-11 Yoksam-dong, Kangnam-ku, Seoul (KR) 135-808

( * ) Notice: Subject to any disclaimer, the term of this patent is extended or adjusted under 35 U.S.C. 154(b) by 203 days.

(21) Appl. No.: 11/916,586

(22) PCT Filed: Jun. 12, 2006

(86) PCT No.: PCT/KR2006/002228

§ 371 (c)(1),
(2), (4) Date: Dec. 5, 2007

(87) PCT Pub. No.: WO2006/132517

PCT Pub. Date: Dec. 14, 2006

(65) Prior Publication Data

US 2008/0272936 A1 Nov. 6, 2008

(30) Foreign Application Priority Data

Jun. 10, 2005 (KR) ..... 20-2005-0016637

(51) Int. Cl.
*G08G 1/07* (2006.01)
*G08G 1/095* (2006.01)

(52) U.S. Cl. ..... 340/925; 340/907

(58) Field of Classification Search ..... 340/925, 340/929, 906–908, 309.16
See application file for complete search history.

(56) References Cited

U.S. PATENT DOCUMENTS

| | | | | |
|---|---|---|---|---|
| 4,025,922 | A * | 5/1977 | Trawick, III | 340/925 |
| 5,654,705 | A | 8/1997 | Houten et al. | |
| 5,663,719 | A | 9/1997 | Deese et al. | |
| 5,898,381 | A | 4/1999 | Gartner et al. | |
| 6,087,962 | A * | 7/2000 | Rojas | 340/907 |
| 6,268,805 | B1 * | 7/2001 | Simon | 340/907 |
| 6,331,824 | B1 * | 12/2001 | Firestone | 340/929 |
| 6,552,668 | B1 * | 4/2003 | Berezovsky | 340/929 |
| 7,375,650 | B2 * | 5/2008 | Lo | 340/907 |
| 2002/0005790 | A1 | 1/2002 | Georgalis | |
| 2004/0189491 | A1 * | 9/2004 | Aydin | 340/925 |
| 2007/0257817 | A1 * | 11/2007 | Mahoney | 340/929 |

* cited by examiner

*Primary Examiner*—John A Tweel, Jr.
(74) *Attorney, Agent, or Firm*—Brooks Kushman P.C.

(57) ABSTRACT

This invention provides a pedestrian signal system not only for normal pedestrians but also for the blind, the disabled person of weak sight, and the illiterate by displaying the remaining time of each signal change in image figures at the signal head and by generating a voice signal in real time. It reduces the cost of the system fabrication, installation and maintenance of the system by combining the five functions of the pedestrian signals such as a walk signal, a stop signal, a remaining time of each signal of red/green and/or the voice generator for blinds in one signal head. Also, this invention provides the useful double safety traffic signal system especially for a school zone by installing LED studs on the stop line at crossroad for warning drivers by blinking the LED studs automatically when the walk signal is in on-mode.

14 Claims, 7 Drawing Sheets

【Fig.5】
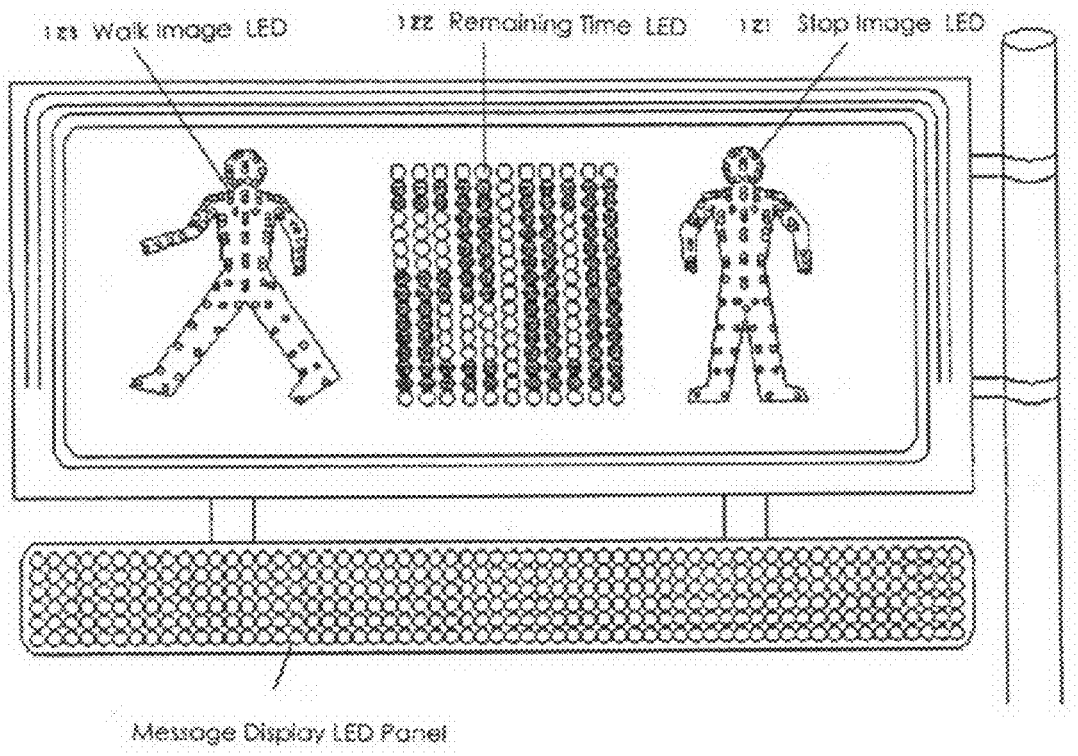

【Fig.6】
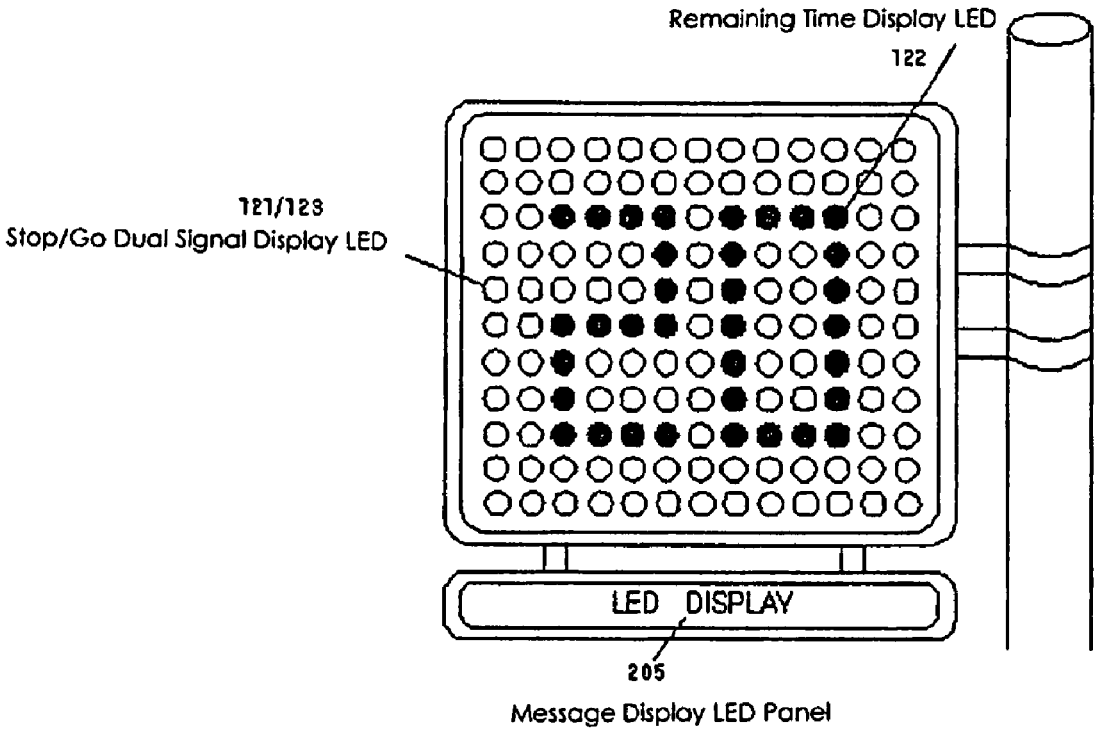

【Fig.7】
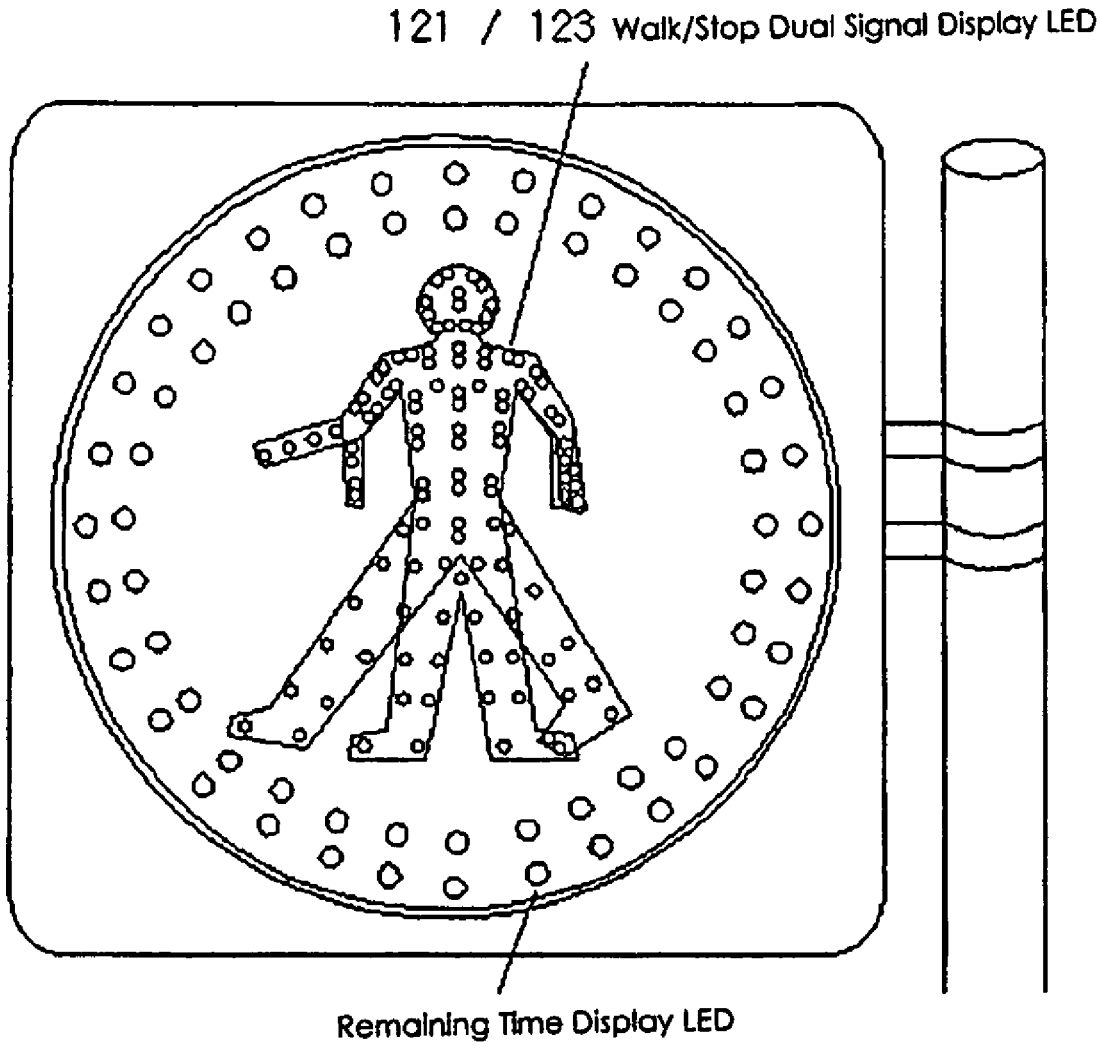

MULTIPURPOSE LED SIGNAL SYSTEM FOR PEDESTRIAN AND TRAFFIC CONTROL

CROSS REFERENCE TO RELATED APPLICATION

This application is a continuation-in-part application of Korean Patent No. 0329419 (Application No. 1999-0027862), Korean Patent No. 0572343 (Application No. 2003-0061271) and Korean Utility Patent No. 028229 (Application No. 2002-0018926) filed concurrently herewith.

TECHNICAL FIELD

This invention relates to provide a pedestrian signal system not only for the normal pedestrian but also for the blind, the disabled person of weak sight, and the illiterate by displaying the remaining time of each signal change in image figures at the signal head and by generating a voice signal in real time.

Accordingly, this invention provides a technology to reduce the cost of the system fabrication, installation and maintenance by combining five functions of pedestrian signals such as the walk signal, the stop signal, the remaining time of each signal of red and green and the audio signal for the blind in one signal head utilizing multicolor light emitting diodes (LED) technologies and real time voice signal generating technologies.

Another object of this invention is to provide a system for displaying messages of advertisement or information for pedestrians, and a system for detecting existence or nonexistence of pedestrians at the crossroad sides with sensors and prevent unnecessary interruption of traffic flow caused by unnecessary signal changes even if there are no pedestrians at the cross road sides.

Additionally, this invention provides the useful double safety crossroad signal system for a school zone by installing LED studs on the stop line at crossroad for warning drivers by blinking the LED studs automatically when the walk signal is in on-mode. Also, utilizing the concept of this invention, it provides a technology to make a single piece traffic signal system instead of the conventional multi piece signal system and it significantly reduces the cost and effectively decreases the traffic accidents at crossroad since drivers can predict the remaining time of each signal change.

BACKGROUND OF THE INVENTION

The conventional pedestrian traffic signal system consists of a walk signal head, a stop signal head, an audio signal generator for the blind and a remaining time counter of each signal change separately. Thus, the cost of system was comparatively higher due to separate fabrication, installation, and maintenance, creating an obstacle to speedy popularization.

To overcome the above problems, a single pedestrian traffic signal system was introduced, however, the single system is displaying the remaining time in two digit numbers and it makes difficulties for the disabled person in weak sight and the illiterate as well as difficulties for recognizing from a relatively long distance.

Moreover, the conventional audible signal generator for the blind at the crossroad was designed to generate an electronic sound signal only, so that the blind could not distinguish the remaining time of the walk signal change, causing inconvenience to the blind pedestrians.

Moreover, the conventional pedestrian traffic signal system could not diagnose a malfunction of the system by itself, nor give warning remotely of the malfunction to the management facilities, causing neglect of the malfunction for a long time.

Moreover, the conventional pedestrian traffic signal system could not detect the existence or the nonexistence of pedestrians at crossroad sides of two-way street, causing unnecessary interruption of traffic flow by changing signal even if there is no pedestrian.

Moreover, the conventional traffic signal system for drivers cannot display the remaining time of each signal change at the cross road and it caused the traffic accidents since drivers could not predict when the signal will change and hurry up to cross.

THE SUMMARY OF THE INVENTION

The problems and limitations of the known and described systems of the background of this invention are overcome by the principles of the present invention whereby all of the signal means of the crossroad for pedestrians such as a walk signal head, a stop signal head, a walk signal remaining time indicator, a stop signal remaining time indicator are combined together in one single multicolor LED display panel and the remaining time of each signal change is displayed by means of a plurality of graphic figures and a voice signal in real time. Thus, it reduces the cost of manufacturing, installation and maintenance to below ½ of the conventional system by combining all of the signal means (a stop signal, a walk signal, a remaining time of each signal) and an audio generating means for the blind together in a single module.

Especially, the remaining time announcement system of the walk signal in voice for example such as "remaining time 40 seconds", "remaining time 30 seconds" is useful not only for the blind but also for the normal pedestrian together since pedestrians need not pay attention to read the remaining time but by hearing voice messages.

Further, the present invention provides a useful means for delivering information by displaying messages such as public notice, an advertisement, a national disaster warming message, in the form of flowing characters or symbols on a LED display panel of the system.

Further, this invention provides the technology to control remotely each pedestrian signal module with an address and deliver warning signal about the malfunction of the signal module by self-diagnosis checking utilizing wire or wireless remote communication means.

Further, the invention provides technology to solve the unnecessary interruption of traffic flow when no pedestrian exists on the roadsides by recognizing existence or nonexistence of pedestrian on the roadsides.

Further, this invention provides useful double safety means at the school zone by flashing signal with the LED studs on the stop line of the crossroad in addition to the pedestrian signal on the roadsides.

Further, the present invention provides innovative technologies to reform the conventional traffic signal heads at crossroads for making LED traffic signal head having a means for displaying the remaining time of signal change and a means for displaying traffic signal such as a red signal or a green signal together in a single signal head so that it reduces almost half of the manufacturing cost since the conventional two signal heads combined in a single signal head as well as reducing traffic accidents at crossroad intersection as drivers recognize the signal changing time of each signal head and need not to hurry to speed up at the crossroads.

Advantageous Effects

The present invention provides technologies to reduce significantly the cost of manufacturing, maintenance and installation of the pedestrian signal system at the crossroads by combining all of the functions of signals such as the walk signal, the stop signal, the remaining time of each signal and the voice generator for the blind together in a one piece, single LED signal head.

Particularly, the means for generating voice signal of the remaining time of each signal change makes the blind or the disabled persons able to recognize the remaining time of the signal in voice and reduce the accidents at the crossroad.

Further this invention provides a useful means to deliver information such as a notice or an advertisement to the pedestrian by displaying the messages on the LED panel of the signal head and it may make the pedestrians who are waiting at the roadsides less bored.

Moreover, this invention provides a system of self-diagnosis for the speedy maintenance and means for remote control of the system by configuring address system of each signal head and means for wire or wireless communication between the signal head modules and the central control facilities.

Also, this invention provides a new concept to install pedestrian signal systems without government budget since those pedestrian signal systems have an advertisement displaying means on the signal head to induce advertisements. Thus, it may solve the budget problem for installing pedestrian signal system at every crossroads countrywide and it is effective to reduce the traffic accidents at the crossroads.

Moreover, this invention may solve the problems of unnecessary blocking of the traffic flow by monitoring existence and nonexistence of pedestrian waiting on the crossroad sides and controlling the signal change.

Additionally, this invention may greatly reduce the accidents at the school zone by its double warning system comprising flashing LED means on crossroad line to give warning to drivers, and means for displaying the signal changing time with graphic figures for the children.

Further, by adopting the inventive concept of this invention, all traffic signal heads may display the remaining time of each signal at the LED signal head itself without any extra costs on the conventional LED signal head, and it may significantly reduce the traffic accidents at the crossroad intersection because the drivers predict the signal changing time of each signal head and need not speed up to hurry crossing.

BRIEF DESCRIPTION OF THE DRAWING

FIGS. 4, 5, 6 and 7 illustrate the examples of signal head according to the present invention.

DETAILED DESCRIPTION OF THE PREFERRED EMBODIMENTS

Referring to the figures, the following is a detailed explanation of the system configuration and operation of the present invention.

Figure 1:
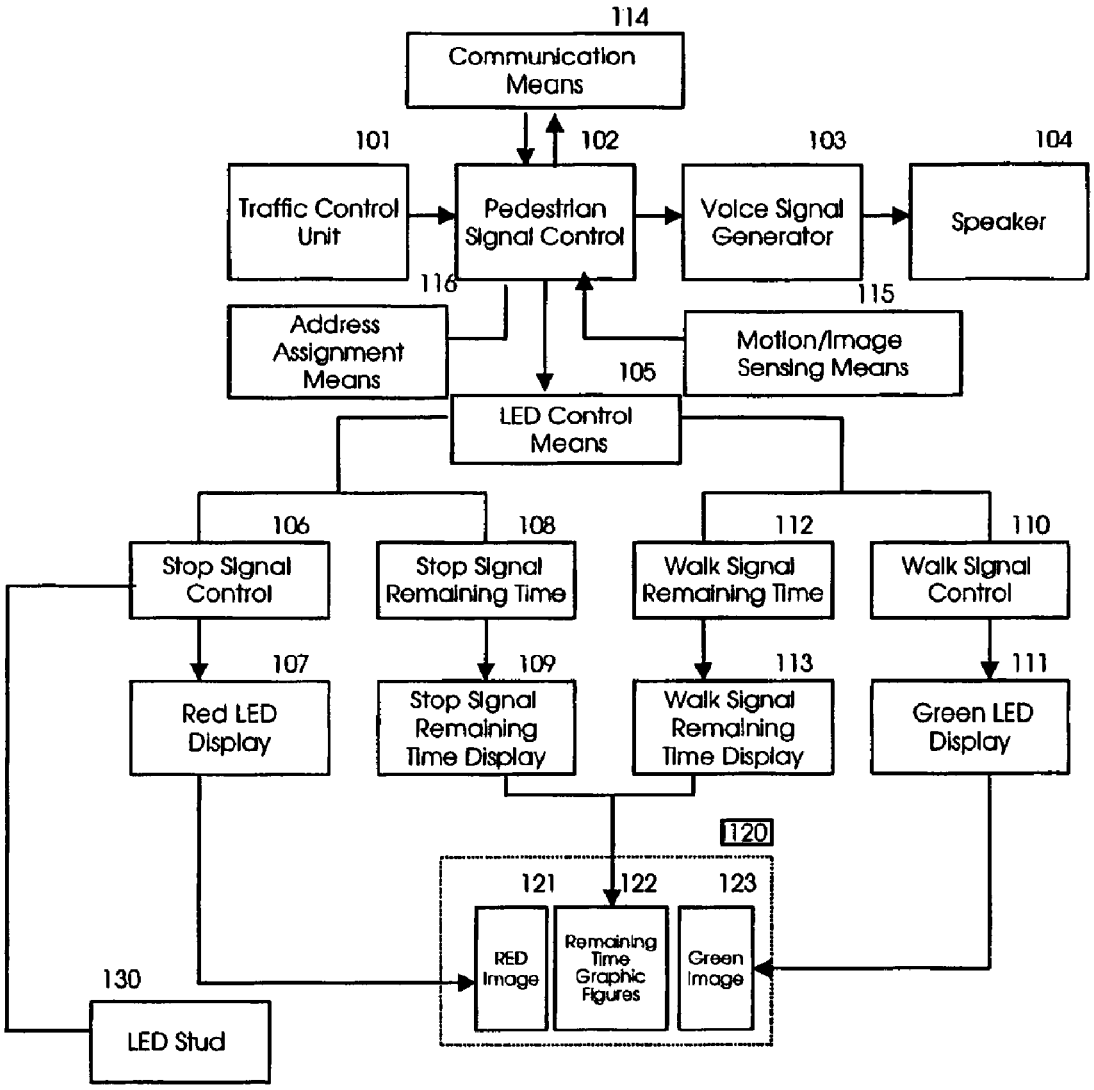
FIG. 1 is a detailed block schematic diagram of the multipurpose LED pedestrian signal system of this invention.

FIG. 1 is a detailed block schematic diagram of this invention and FIGS. 4, 5, 6 and 7 illustrate the examples of signal head of the present invention. As described in FIG. 1 and FIG. 4, the present invention comprises a control means (102) for receiving a signal control data from traffic control unit (101) and for controlling the function of the system by calculating the remaining time of each signal change of a stop signal or a walk signal and divides the time interval of signal change by the number of graphic figures to deliver the data to a LED control means of the system to display, a LED signal head (120) comprising multicolor LED panel and a housing to display the stop signal in a red graphic image, the walk signal in a green graphic image, the remaining time of walk signal in green graphic figures, remaining time of stop signal in a red graphic figures, and a LED control means (105) comprising a character generating means and a LED driver means for controlling the LED panel of the signal head with a system drive means to display the walk signal graphic image with its remaining time in graphic figures and the stop signal graphic image with its remaining time in graphic figures according to the instruction signal from the control means (102) in the manner of eliminating or blinking the number of the figures according to the remaining time passed.

In addition to the above configuration, it may add a voice signal generator means (103) that generates the remaining time of the walk signal in a voice signal with a certain time interval according to the control data from the control means (102), and it may be a useful signal system not only for the blind, but also normal pedestrians. This system may additionally include a motion/image detector means (115) coupled to the control means (102) to prevent any unnecessary interruption of the traffic signal by detecting the existence or nonexistence of pedestrians waiting at the roadsides.

Also, this system comprises a plurality of LED stud means (130) installed along with the stop line of the crossroads and connected with the stop signal control means (106) for flashing LED signal when the stop signal head activated. It may be an additional signal system on the pedestrian signal and greatly reduce the traffic accidents especially at a school zone by warning to drivers approaching to the crossroads.

Figure 2:
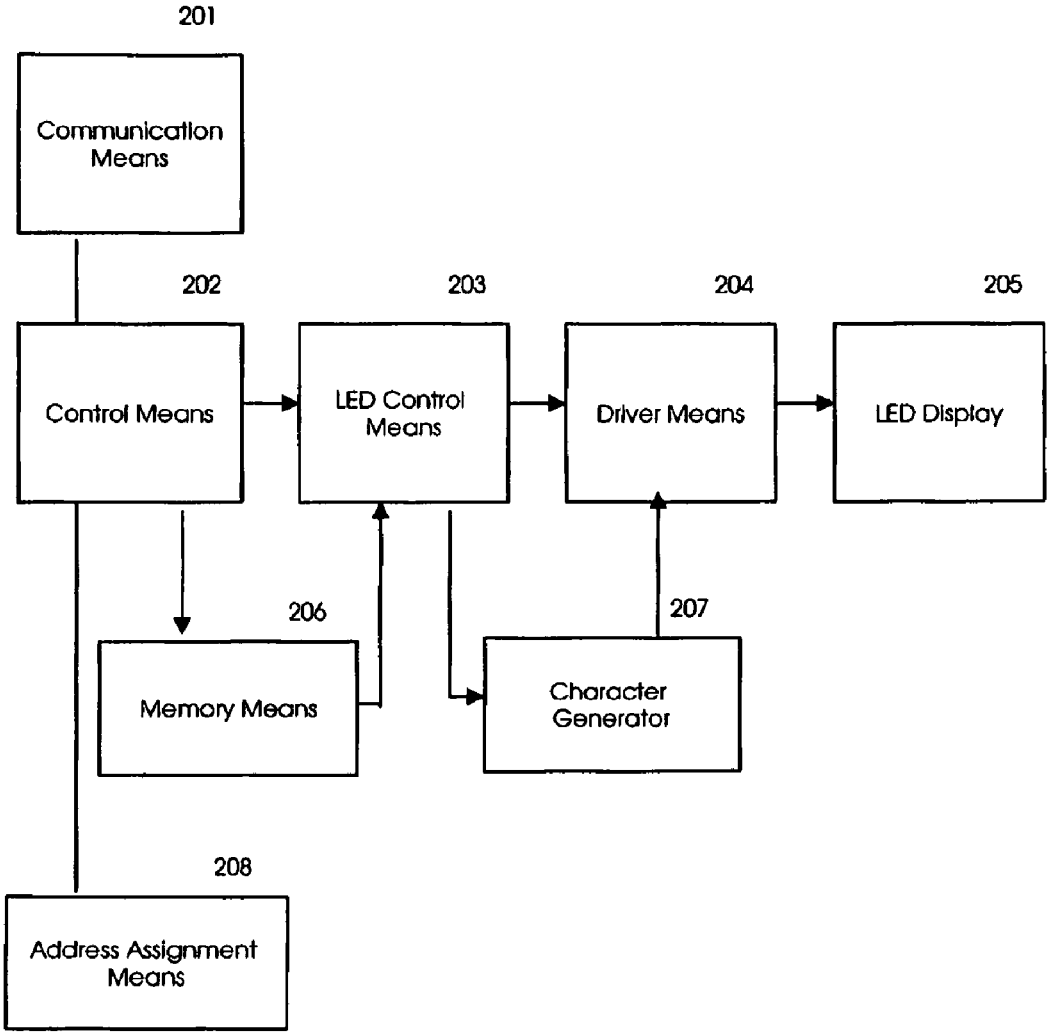
FIG. 2 is a detailed block diagram of remote control system of this invention.

As described in FIGS. 1 and 2, an address assignment means (116) for designating an address of each signal head and a wire or wireless communication means (114) between each signal head and a host computer of the system management facilities may be added on this system coupled with the control means (102), so that it provides a remote control means for controlling the system and maintaining the system from an outside host computer.

Further, this system may comprise a LED display panel at the upper part or the lower part of the LED signal panel separately. In this case, FIG. 2 illustrates the system configuration that comprises a wire or wireless communication means (201) for communicating with a display control means (202) and a host computer that is located outside and controls the system, a memory means (206) for memorizing message data to display delivered from the outside host computer by the communication means, a character generator means (207) for generating images or characters to display, a driver means (204) for displaying messages such as characters numbers or images in the form of flowing messages on the LED panel (205) or controlling the size, color or flowing speed on the LED panel, and an address assignment means (208) for designating the address of the LED panel (205). The system provides a useful tool for displaying messages, advertisements, and information for the pedestrian while they are waiting for the signal change and it makes money for free installation by advertisement.

Figure 3:
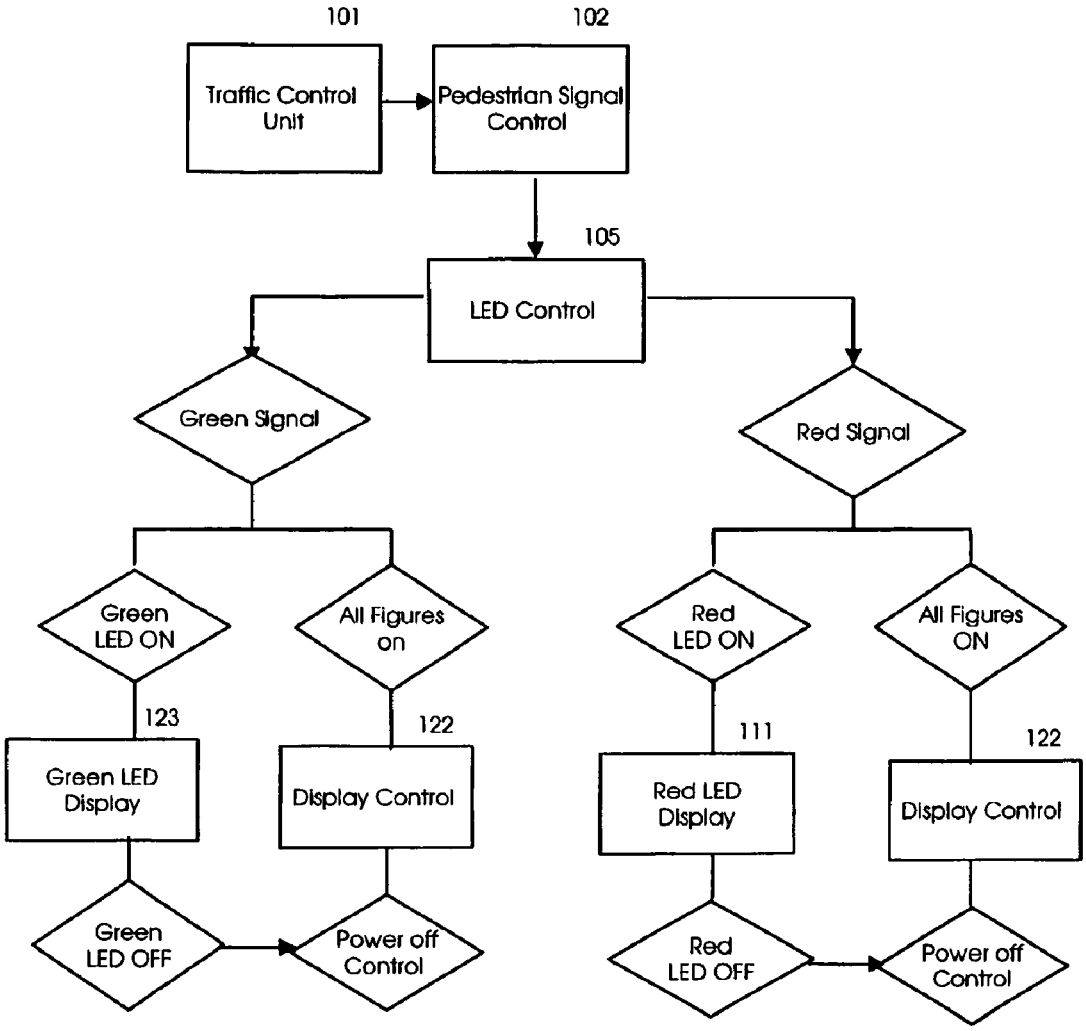
FIG. 3 is a detailed block diagram of the system operation according the present invention.
Figure 4:
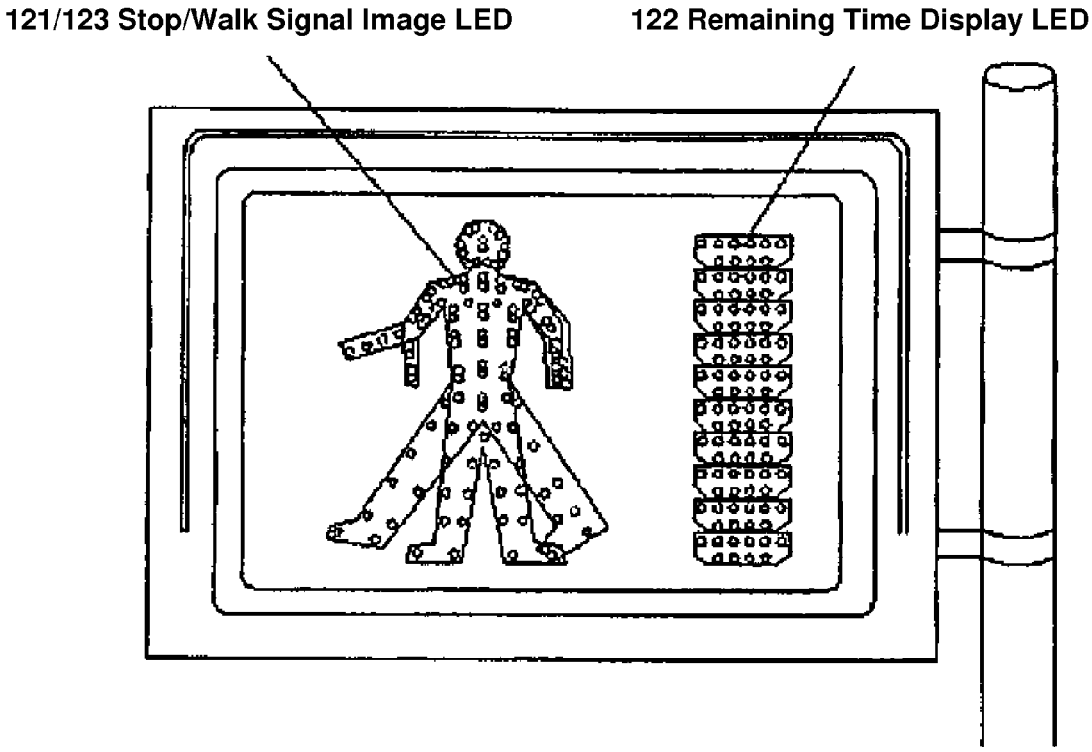

Referring to FIGS. 1, 3 and 4, a detailed block diagram and an example of the present invention are described. The CPU of the control means (102) receives signal control data from the outside traffic signal control unit (101) and calculates the length of time interval of each signal change. If the system is designed to display the remaining time by figures (like FIGS. 4 and 7), the time interval may be divided by the number of the figures and display all of figures on mode when the signal changed and eliminate or blinking the number of figures in regular order according to the divided time interval passed. If the system is designed to display the remaining time in number (like FIGS. 5 and 6), the remaining time may be divided by time interval of a certain time unit decided by the system designer (such as 5 seconds, or 10 seconds) and display the remaining time of each signal change in two digit number.

Referring to FIG. 1, if the stop signal is received from the control means (102), the LED control means (105) controls the stop signal control means (106) to display the signal of LED in red color and at the same time it controls the red signal remaining time control means (108) to display the remaining time in red color in graphic figures to eliminate the number of figures according to the time interval established by the said red signal remaining time control means (108).

If the walk signal is received from the control means (102), the LED control means (105) controls the walk signal control means (110) to display the signal of LED in green color and at the same time it controls the green signal remaining time control means (112) to display the remaining time in green color in graphic figures to eliminate the number of figures according to the time interval established by the green signal remaining time control means (112).

Further, if a manual control signal is received from the outside traffic signal control unit (101), the control means (102) instructs the LED control means (105) to display the walk signal or the stop signal only according to the manual control signal from the said control means (102) and to eliminate or blink the remaining time system of each signal.

Referring to FIG. 4, a detailed block diagram of pedestrian LED signal head with countdown figures (122) according to the present invention is described, the walk signal (123), the stop signal (121) and the remaining time indication of each signal (122) are displayed by LED on the single LED panel. The LED's are dual color LED of red and green so that it may display the walk signal and its remaining time in green color when the walk signal received, and the stop signal and its remaining time in red color when stop signal received. The remaining time indicators of each signal (122) are located on the right side or left side of the stop/walk signal combination (121/123) on the LED panel of the signal head and designed to indicate the remaining time of each signal in graphic figures, thus, four kinds of signals such as the walk signal and its remaining time indicator signal, and the stop signal and its remaining time indicate signal are displaying in a single piece LED panel of the pedestrian signal head.

Another example of this invention is described in FIG. 5, the remaining time indicator (122) comprising dual LEDs or single LEDs is located between the green LEDs for walk signal (123) and the red LEDs for stop signal (121). Regarding LEDs of this invention, the LED panel is comprises multicolor LEDs, however it may be the same effect even making the LED panel with a plurality of cross-arranged LED of single color LEDs instead of multicolor LEDs to meet the standard luminous intensity values of each country.

The symbol images of stop signal and walk signal may be "UPRAISED HAND/WALKING PERSON", "STANDING PERSON/WALKING PERSON" or any other symbol/images such as "x/↑" or "RED/GREEN" according to the standard of each country.

The remaining time indicator of this invention as described on FIG. 4 may be designed with image figures such as ∇(Triangle), □(Ladder), or —(Bar) for easy recognition for disabled person in weakness of sight(amblyopic), person of illiteracy, or any person who can not read letters.

Also, the signal head module of this invention can by designed as a clock plate as in FIG. 7. The LED display panel in FIG. 7 is configured as a square or circular watch plate comprising the image of stop/walk signal combination (121/123) at the center part of the watch plate and remaining time (122) of each signal at the outer girth of the watch plate by a form of a bar or a figure of the time stamp arranged equally in all direction around.

The number of figures (122) can be divided in 4 or 6 like a watch plate and all of figures are in on-mode when the signal changed and the figures are eliminated according to the time interval data from the control means (102) so that pedestrian can recognize the remaining time of each signal by the number of the symbol left on the panel. This design is useful since human beings are used to calculate time by symbol of a clock. Accordingly, the present invention described in FIG. 4 and FIG. 7 can be modified to two signal heads or two panels in a single head for displaying the stop signal with its remaining time and the walk signal with its remaining time separately, or one of signal head or panel displays the graphic image of the walk or the stop signal and the other head or panel displays the remaining time of each signal alternately.

Additionally, the present invention provides a useful technology for innovating the conventional traffic signal to indicate the remaining time of each signal together with a single traffic signal head. FIG. 6 illustrates the inventive concept of the above description. The traffic signal comprises a plurality of multicolor LEDs for displaying the traffic signal (121/123) and its remaining time of the signal change (122) together in a one-piece signal head. It comprises a traffic control unit for controlling traffic signal heads for displaying stop signal in red color and go signal in green color by changing the color of LED of traffic signal head and the remaining time of each signal change with two digit number in the specific time unit which divided its signal changing time interval with a certain time interval according to the program of CPU of the traffic control unit, a LED traffic signal head comprising a housing and a LED display panel of a plurality of multicolor LEDs for displaying the stop signal in red, the go signal in green and its remaining time of each signal change in white or yellow at the center part of each signal according to the instruction signal from the traffic control unit.

Also, this system can be designed with the LED traffic signal head comprising the stop signal head and the go signal head separately, or the stop signal panel and the go signal panel separately in a single head, and the remaining time of each signal may display at other signal head or panel alternately. With the above concept, it is easy to change the conventional traffic signal head of red and green to display the remaining time of each signal at the signal head, or to add a message displaying panel (205) for displaying traffic information at the signal head.

This invention provides the concept to reduce the cost such as manufacturing, installation and maintenance of the signal system by simplifying all of conventional signal head of walk (go) signal head, stop signal head and remaining time indicator of each signal into a one piece signal head.

Even the size of the signal head of the present invention is relatively larger to show the signals and messages more clearly to the drivers or pedestrian but the cost is lower than the conventional system due to the simplicity of design and reduction of electricity cost by LEDs.

Also, the technology described above may be useful both for pedestrian signal system and traffic signal system since the drivers or the pedestrians can clearly recognize the signal and the remaining time of each signal.

As described on FIG. 1, this invention provides a voice signal generating means (103) for generating a real time voice signal of the remaining time of each signal for the blind or disabled person of weak sight.

For example, it announces the remaining time in a voice, such as "40 seconds left, 35 seconds left, 30 seconds left" and it is useful for both the blind and normal pedestrians to predict the remaining time of the signal change in voice message.

Regarding the above concept, a signal generator for generating dual-tone signal may be used instead of the voice generator means for the similar effect for the blind to predict the remaining time of the signal by the interval of dual signal tones.

Referring to FIGS. 2 and 6, this invention provides the technology for displaying messages such as information, advertisement through the LED panel attached on the pedestrian signal head of the president invention and such a function can be done by adding an independent LED panel (205) for the above functions having a LED control means (203) for displaying messages in the form of flowing messages on the LED panel, an address assignment means (208) for designating an address of the LED panel, a communication means (201) for receiving message data from an outside host computer by wire or wireless network, a memory means (206) for memorizing the message data received by the communication means, and a control means (202) to control the above means for receiving messages according to the address through the communication means, storing the message data in the memory means and controlling the LED control means for displaying the messages.

In the above configuration, this system may be designed to regularly display specified messages or advertisements on the LED panel by configuring a attachable LED control module having or memory means for memorizing the messages and a central processing unit with a software program to display the memorized messages according to the software program of the system.

Again referring to FIG. 1, this system further comprises sensors for detecting malfunction of the system. The central processing unit (CPU) of the control means (102) regularly according to the software program detects the malfunction of the system through the sensors and deliver the information with the address of the system to the outside host computer of the system management facilities whenever it detects the malfunctions.

Additionally, this system further comprises a wireless communication means that can detect a signal at limited distance only (for example, Blue-tooth communication method may be used), for detecting a communication terminal's approach within the effective distance and changing data between the system and the terminal. Thus, if the terminal receives data of malfunction from the system by passing through the system the maintenance personnel immediately notice the malfunction of the system and repair it quickly.

Further, referring to FIG. 1, this system may comprise sensing means (115) such as image detector means, motion detector means IR sensors or UV sensors outside of the system for detecting existence or nonexistence of pedestrians on the crossroad sides, and add a software program to detect and analyze existence or nonexistence of pedestrians at crossroad sides. Then, if nonexistence is detected during the programmed time the control means (102) may send data to the outside traffic control unit (101) and controls the system not to change the signal and the remaining time indicator means are turned to off-mode. It may solve the problems of the conventional pedestrian signal system that interrupt the traffic by changing the signal even if no pedestrians exist on the roadsides.

The above configuration can also comprise a digital camera on the pedestrian signal pole in addition to the sensors and the software program for comparing data of existence or nonexistence of pedestrians waiting on the roadsides and it may reduce the error of the system.

The above systems for detecting pedestrians are typically useful for the pedestrian signal system of two-way traffic roads. Also the above technology is useful to detect pedestrians, especially for the disabled person on the traffic road and control the signal not to change until the image sensor/digital camera finds that the pedestrians have passed. Also, this invention provides a technology to improve the safety of a school zone. For this purpose, a plurality of LED stud means (130) may be installed along with the vehicle stop line of the crossing and connect wire between the pedestrian signal control means (102) or the stop signal control means (106) and LED control line of the LED studs. Thus, if the pedestrian signals of the roadsides display walk (green) signal, the control means (102 or 106) controls LED of the stud's on-mode for blinking for warning drivers.

Also, this invention provides a technology to improve the safety on school zone. For this purpose, a plurality of LED stud means (130) may install among with the vehicle stop line of the crossed and connect wire between the pedestrian signal control means (102) or the stop signal control means (106) and LED control line of the LED studs. Thus, if the pedestrian signals of the roadsides display walk (green) signal, the control means (102 or 106) controls LED of the stud's on-mode for blinking for warning to drivers.

This system also makes a software program to control the LED of studs for blinking in yellow or red or mixed color signal for warning drivers to approach the school zone area carefully whenever the pedestrian signal is changed to stop signal. It may greatly enhance the safety at the school zone area for the children.

The present invention may be embodied in not only pedestrian signal system but also the other traffic control signal system without departing from the inventive concept of this invention.

Although illustrative embodiments of the present invention have been described in detail with reference to accompanying drawings, it is understood that the invention is not limited to those precise embodiments and that changes modifications may be effected therein by those in part without departing from the scope and spirit of the invention.

The invention claimed is:

1. A pedestrian light-emitting diodes (LED) traffic signal system for displaying a walk signal, a stop signal and a remaining time of the walk signal and stop signal before they change in a one piece signal head the system comprising:

(a) a control means for receiving a signal control data from a traffic control unit and controlling the function of the system by calculating the remaining time before a signal change of the walk signal and the stop signal by dividing the amount of a time interval of the signal change by a number of graphic figures for displaying the remaining time of each signal with the change of the number of figures;

(b) a LED signal head comprising a multicolor LED panel and a housing for displaying the walk signal in a graphic image, the stop signal in a different graphic image at the same place on the LED display panel as the walk signal by changing the color of the LEDs, the LED panel also displaying the amount of remaining time of each signal in graphic figures arranged in vertical order at right or left side of the stop and walk image display combination; and (c) a LED control means comprising a character generating means and a LED driver means for controlling the LED display panel to display the graphic image of each signal and a plurality of graphic figures representing the remaining time of each signal in the manner of eliminating or blinking figures in regular order according to the remaining time passed.

2. The system of claim 1, further comprising a sensing means such as an image detecting means, a motion detecting means, IR sensing means, UV sensing means or a digital camera outside of the signal system for detecting existence or nonexistence of pedestrians waiting at the crossing roadsides with a software programmed to the control means for analyzing the existence of pedestrians and for controlling the signal system to not change the signal to avoid unnecessary blocking of the traffic flow if pedestrians are not detected.

3. The system of claim 1, further comprising a voice signal generating means with an audio amplifier and an on/off switch button on a pedestrian signal pole for generating the remaining time of the walk signal in a voice signal at a certain rate of time calculated by the control means when users activate the on/off switch button on the pedestrian signal pole.

4. The system of claim 1, further comprising a plurality of LED studs installed along a vehicle stop line on the crossroad and connected with the control means for warning approaching drivers by blinking the LED when the walk signal is activated.

5. The system of claim 1, wherein the control means further comprises an address assignment means for designating an address of the system, a LED message display panel for displaying messages, a wire or wireless communication means for receiving data of messages or instruction and for transmitting data of system failure or malfunction between the system and a host computer of control facilities, and a memory means for memorizing the message data received by the communication means for displaying messages, information or advertisement on the LED message display panel, or for delivering warning signal of the system failure to the host computer.

6. The system of claim 5, wherein the LED message display panel is further attachable and located at an upper part or under part of the pedestrian signal head separately for easy replacement or repairing.

7. The system of claim 1, further comprising a message display system comprising an address assignment means for designating the address of the system, a LED message display panel for displaying message, a wire or wireless communication means for receiving data of messages or instruction and for transmitting data of system failure or malfunction between the system and a host computer of control facilities, a memory means for memorizing the message data received by the communication means for displaying, and a LED control means for controlling the LED display panel and control means for controlling the system operation for displaying the messages received from the host computer on the LED message display panel that is attached to the signal system separately.

8. The system of claim 5, further comprising the LED message display panel at the top or the lower part of the stop/walk signal combination for delivering a message in various patterns and a removable LED control module having a content of the message and a software program for displaying in various patterns the content that can be optionally changed by replacement of the module.

9. The system of claim 1, further comprising an address assignment means for designating an address of the system, a sensing means for detecting a malfunction signal of the system and a wire or a wireless communication means for delivering the malfunction signal detected by the sensing means with the address data of the system to a host computer of a system management facilities for warning.

10. The system of claim 9, further comprising a wireless remote detection and communication means for detecting automatically a repairer's terminal approach when the terminal approaches within the signal transmitting range of the communication means or passes by the system for exchanging data between the system and the repairer's terminal.

11. The system of claim 1, wherein the LED display panel further comprises a plurality of cross-arranged LEDs of single color instead of multicolor LEDs for displaying the stop signal and its remaining time with red LEDs, and the walk signal and its remaining time with green LEDs.

12. A pedestrian light-emitting diodes (LED) traffic signal system for displaying a walk signal, a stop signal and a remaining time of the each walk signal and stop signal before they change in a one piece signal head, the system comprising:

(a) a control means for receiving a signal control data from a traffic control unit and controlling the function of the system by calculating the remaining time before a signal change of the walk signal and the stop signal by dividing the amount of a time interval of the signal change by a number of graphic figures for displaying the remaining time of each signal with the change of the number of figures;

(b) a LED signal head comprising a multicolor LED panel and a housing for displaying the walk signal graphic image and the stop signal graphic image spaced apart on the LED display panel, the LED panel also displaying the amount of remaining time of each signal in graphic figures arranged between the stop and walk images; and (c) a LED control means comprising a character generating means and a LED driver means for controlling the LED display panel to display the graphic image of each signal and a plurality of graphic figures representing the remaining time of each signal in the manner of eliminating or blinking figures in regular order according to the remaining time passed.

13. The system of claim 1, wherein the LED display panel further comprises the walk signal designed with moving image figures in action according to the control signal from the LED control means.

14. A pedestrian light-emitting diodes (LED) traffic signal system for displaying a walk signal, a stop signal and a remaining time of the each walk signal and stop signal before they change in a one piece signal head comprising, comprising:

(a) a control means for receiving a signal control data from a traffic control unit and controlling the function of the system by calculating the remaining time before a signal change of the walk signal and the stop signal by dividing the amount of a time interval of the signal change by a number of graphic figures for displaying the remaining time of each signal with the change of the number of figures;

(b) a LED signal head comprising a multicolor LED panel in the shape of a circular or square watch plate and a housing for displaying the walk signal graphic image and the stop signal graphic image in the same space on the LED display panel by changing the color of the LEDs, the LED panel also displaying the amount of remaining time of each signal in a plurality of graphic figures arranged around a perimeter of the watch plate; and (c) a LED control means comprising a character generating means and a LED driver means for controlling the LED display panel to display the graphic image of each signal and the plurality of graphic figures representing the remaining time of each signal in the manner of eliminating or blinking figures in regular order according to the remaining time passed.

* * * * *